United States Patent [19]

Britton

[11] 4,186,430

[45] Jan. 29, 1980

[54] TELESCOPING CANDLE LANTERN

[76] Inventor: Bruce G. Britton, P.O. Box 659, Pt. Reyes Sta., Calif. 94956

[21] Appl. No.: 823,073

[22] Filed: Aug. 9, 1977

[51] Int. Cl.[2] ..... F21V 35/00; F21L 19/00

[52] U.S. Cl. ..... 362/162; 362/161; 362/396

[58] Field of Search ..... 362/396, 161, 162, 163

[56] References Cited

U.S. PATENT DOCUMENTS

| | | | |
|---|---|---|---|
| 963,826 | 7/1910 | Stonebridge | 362/162 |
| 1,304,088 | 5/1919 | Patterson | 362/162 |
| 2,517,197 | 8/1950 | Gill | 362/162 |

*Primary Examiner*—Samuel W. Engle
*Assistant Examiner*—Donald P. Walsh
*Attorney, Agent, or Firm*—Townsend and Townsend

[57] ABSTRACT

A candle lantern comprises a cylinder for enclosing a candle, a telescoping chimney with a protective reflector, a tubular candle holder with means for feeding an expendable candle thereby to maintain the wick at desired position relative to the reflector. The candle holder includes a wax dam comprising a cap and a tapered tube with a labyrinth seal therebetween for minimizing overflow and leakage of wax. The lantern may be telescoped from a compact and tight collapsed position to a fully telescoped lighting position to a partially collapsed operating position. Annular detents and ribs on the inside of the cylinder and on the outside of the chimney interlock at the three operating positions. An annular rubber ring is provided around one rim of the cylinder and a rubber plug with an annular rubber ring is provided at the other end of the cylinder. The rubber rings extend from the body of the cylinder to protect against damage due to shock. Further, the plug supports the candle holder and candle feed. Ribs and detents are provided within the ring and plug as well as the body and candle holder to lock the device in a shock resistant yet easily assembled and disassembled unit.

7 Claims, 5 Drawing Figures

TELESCOPING CANDLE LANTERN

BACKGROUND OF THE INVENTION

This invention relates to a candle light source, and particularly to a compact portable and rugged lantern assembly employing a candle as a light source.

There has developed a need for a simple, compact light source, specially for backpacking, camping and emergencies. The particular need is for a lantern which is light-weight, and very rugged and corrosion free and highly reliable. Various lanterns employing liquid and gas lanterns are known, including kerosene, oil, sterno, butane and propane.

A wax candle is an elegantly simple and relatively inexpensive light source. However, there are numerous disadvantages to the candle. For example, it is easily blown out, its light level is low and it changes shape as it is consumed so that the wick and consequently the flame is displaced and light output is non-directional. Moreover, even the so-called "dripless" candles do drip wax which may foul a lantern or candle holder. What is therefore needed is a lantern which can utilize the advantages of a candle without its disadvantages.

BRIEF DESCRIPTION OF THE PRIOR ART

Various candle holders are known to the art. For example, Danish Pat. No. 24,426 (1919) discloses a wooden case which may be used as a candlestick, lamp or cycle lantern wherein a candle is held within a cylindrical chamber under the compression of the spring to maintain the relative position of the candle flame as the candle is consumed. No provision is made for collapsible storage of such a device or for protection against wax leakage.

SUMMARY OF THE INVENTION

According to the invention, a candle lantern comprises a cylinder for enclosing a candle, a telescoping chimney with a protective reflector, a tubular candle holder with means for feeding an expendable candle thereby to maintain the wick at desired position relative to the reflector. The candle holder includes a dam comprising a cap and a tapered tube with a labyrinth seal therebetween for minimizing overflow and leakage of wax, to control burn rate, and to assure the most efficient use of the candle wax. The lantern may be telescoped from a compact and tight collapsed position to a fully telescoped lighting position to a partially collapsed operating position. Annular detents and ribs on the inside of the cylinder and on the outside of the chimney interlock at the three operating positions. An annular rubber ring is provided around one rim of the cylinder and a rubber plug with an annular rubber ring is provided at the other end of the cylinder. The rubber rings extend from the body of the cylinder to protect against damage due to shock. Further, the plug supports the candle holder and feed. Ribs and detents are provided within the ring and plug as well as the body and candle holder to lock the device in a shock resistant yet easily assemble and disassembled unit.

A lantern according to the present invention is directional prividing a shielded and reflected light output through the use of a reflector. Further, the flame of the lantern is surrounded by a chimney protecting the flame from the wind. Furthermore, the telescopic feature of the lantern permits it to be lit even under moderately windy conditions.

The lantern is easily disassembled for cleaning and replacement of parts without any need for screws, bolts and the like which are usually lost. The lantern can be used while boating, walking or even cycling without blowing out or blinding the user. The wax dam design is such that it prevents wax from leaking out so wax cannot gum up the apparatus or leak out.

In its collapsed position, the lantern is sufficiently insulated against shock to withstand the rough treatment typical of outdoor activity. The lantern is easily hung with a convenient hook and cable which also serves as a clamp to hold the lantern in a collapsed position. Other advantages of the invention will be apparent on a closer examination of a detailed description of the preferred embodiment.

DETAILED DESCRIPTION OF A PREFERRED EMBODIMENT

The invention is illustrated by the figures. The invention comprises a candle lantern 10 suitable for outdoor use. It is compact and shock resistant, and it can be operated under windy conditions.

Figure 1:
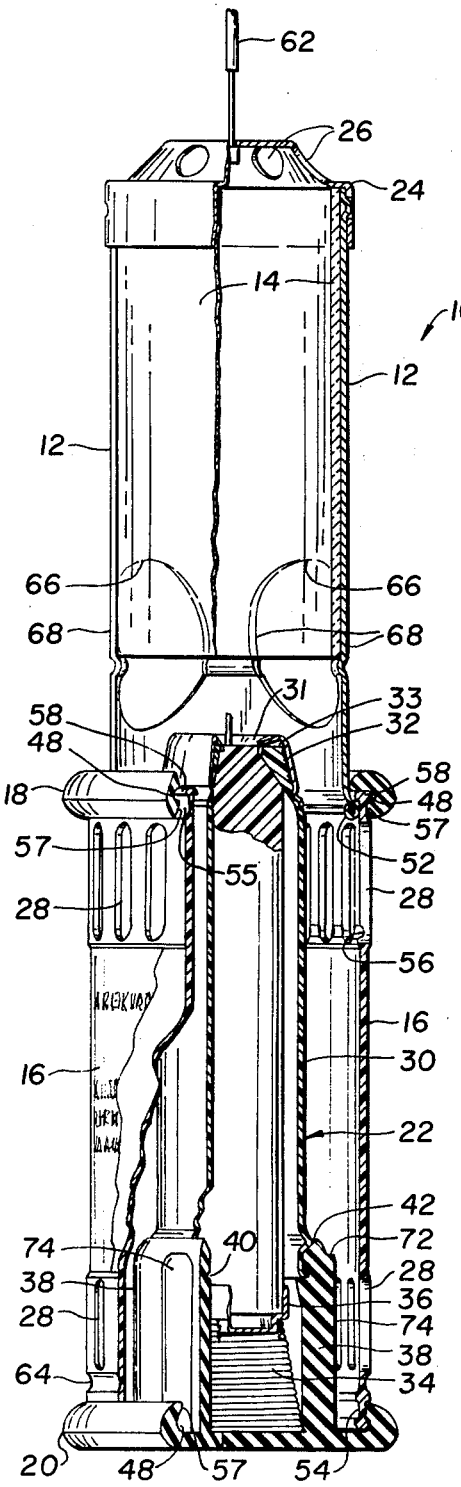
FIG. 1 is a side elevational view in partial cross-section showing the lantern in fully extended lighting position.
Figure 2:
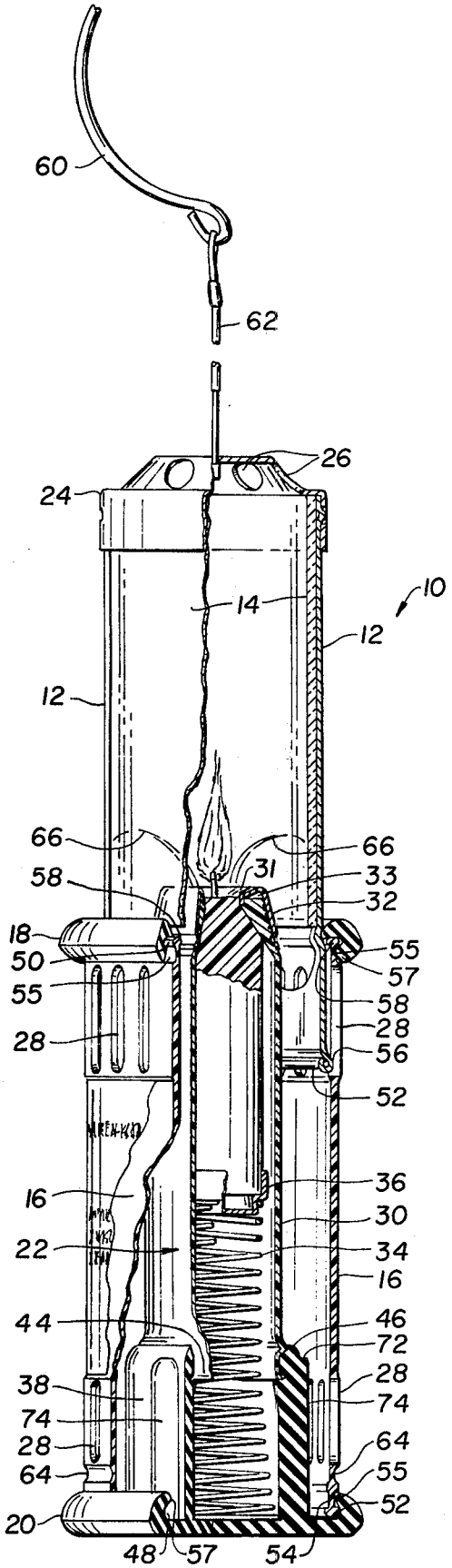
FIG. 2 is a side elevational view and partial cross-section showing the lantern partially extended operating position.
Figure 3:
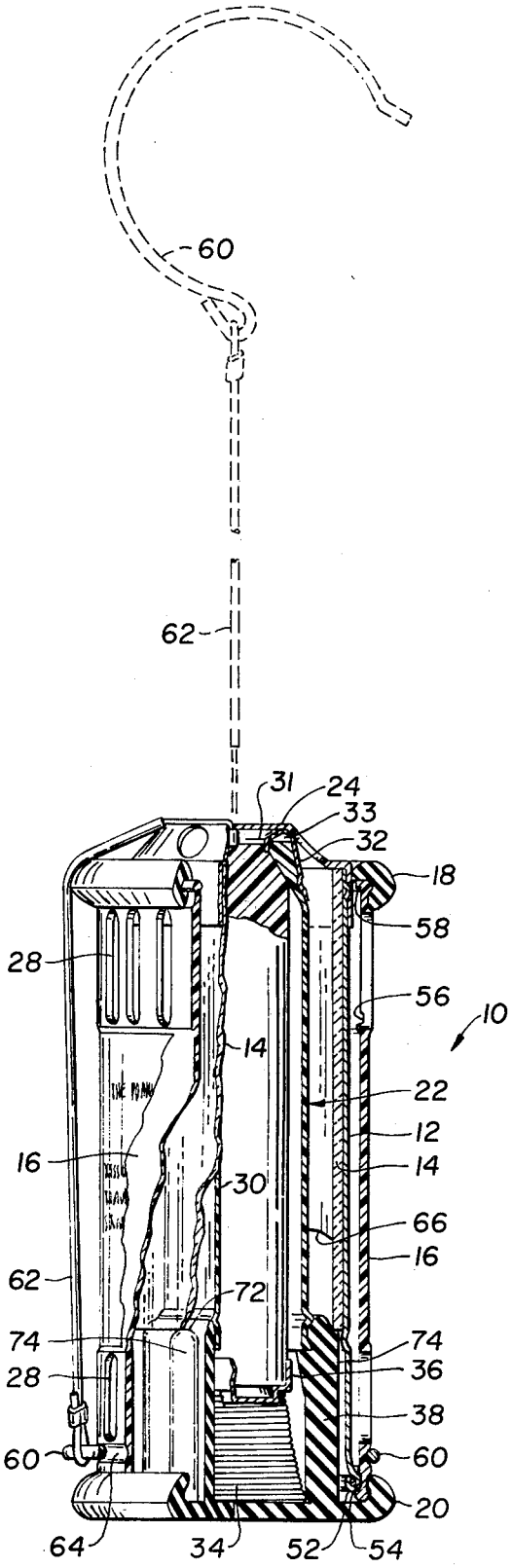
FIG. 3 is a side plan view of the lantern in partial cross-section showing it in its full collapsed position.

As shown in FIGS. 1, 2 and 3, the lantern 10 includes a reflector shield 12 which partially encloses a glass chimney 14. The shield 12 and chimney 14 telescopically mount within a cylindrical base 16 having at the top end a hard rubber annulus 18 and at the bottom end a hard rubber plug 20. A candle holder 22 is attached to the plug 20 within the base 16 as hereinafter explained.

A metal cap 24 with exhaust vents 26 is included at the top of the reflector shield 12. The shield 12 and chimney 14 may be disposed in three stable positions, a first extended position as in FIG. 1 showing a fully extended reflector 12, and a second extended position as in FIG. 2 showing a partially extended reflector 12. In the third position, the shield 12 may be collapsed into a fully enclosed position, as shown in FIG. 3. In the collapsed position, the lantern 10 is shock resistant and the glass chimney 14 is protected.

In the position of FIG. 1, the lamp is fully extended, exposing the top of the handle holder 22, which permits flame ignition. FIG. 2 illustrates the normal operating position, wherein the chimney 14 encloses the top of candle holder 22, thereby protecting the flame against drafts.

Base 16 includes intake vents 28 in the form of decorative longitudinal slits through its wall. Such slits may be provided around the lower end of base 16 to supply fresh air to a flame within the lantern 10. In addition, such slits may be provided around the upper end of base 16 as shown for intake of additional air. The center portion of the cylindrical base 16 may be reserved for labelling and instruction.

Candle holder 22 comprises a candle tube 30, an annular metal cap 32, a bias spring 34, a candle base cup 36, and a base mount 38. Base mount 38 may be formed integrally with plug 20, providing a tubular portion interlocking with the candle tube 30.

The base mount 38 may include an annular, inwardly facing detent 40 below its upper rim, and its upper rim may include a counterbore 42 (FIG. 1). Complementary to the detent 40 and counterbore 42, may be flanges around the base of candle tube 30. A bottom rim flange 44 mates with detent 40 and intermediate flange 46 mates with counterbore 42 (FIG. 2).

The candle cup 36 may include concentrically stepped sides to accomodate candles of different diameter. In addition, the bottom of the candle cup may be annularly indented to mate with the end of a coil of bias spring 34. Bias spring 34 is preferably helical so that it is longitudinally collapsible to a compact size.

The rubber plug 20 and rubber annulus 18 each extend radially outwardly from the upper and lower rim of base 16. Annulus 18 and plug 20 each include a radially inwardly disposed annular detent 48 (FIG. 1) which mates with an annular flange 50 (FIG. 2) at the upper and lower rims. Additionally, grooves 55 (FIG. 2) may be included adjacent the rim for engaging the inner edge 57 (FIG. 1) of annulus 18 and plug 20.

Shield 12 includes a radially disposed compression ring 52 along its lower edge. Compression ring 52 is operative to engage a recess 54 at the bottom of base 16, as shown in FIG. 3, and it is also operative to engage an inwardly disposed recess 56 in base 16 intermediate of the top and the bottom as shown in FIG. 2. The mating of ring 52 with intermediate recess 56 defines the operating position of the chimney 14 with respect to lantern base 16.

Ring 52 is also operative to engage an inwardly disposed flange 58 around the top rim of base 16, as shown in FIG. 1. Ring 52 and flange 58 cooperate to prevent the accidental removal of chimney 14.

Means are provided for hanging lantern 10. Specifically, a hook 60 of a diameter slightly larger than the diameter of base 16 is attached to a cable 62 which in turn is connected to cap 24. The hook 60 is adapted to fit into a hook groove 64 adjacent the lower end of base 16. The hook 60 thereby holds the lantern in a closed position by means of cable 62.

It has been found that the reflector shield 12 tends to be heated by the candle flame during normal operation. Orifices 66 are provided in the lower side of the shield 12 defining three relatively narrow struts 68. The orifices 66 and struts 68 provide isolation for the upper part of the shield 12 to inhibit the conduction of heat to the base of the shield 12 which might otherwise cause damage to relatively low melting point parts, such as rubber annulus 18.

A further feature of the collapsed lantern is shown in FIG. 3. As is seen, the base mount 38 extends sufficiently up the interior side wall of lantern base 16 to engage the lower end of chimney 14. A partial shoulder 72 is provided at the rim of base mount 38 for this purpose. Fluting 74 extends longitudinally along the outside of base mount 38 and is operative to guide the shield 12 into the collapsed position (FIG. 3). With the lantern in the fully collapsed position, the compression ring 52 engaging recess 54 and vent cap 24 engaging rubber annulus 18, the glass chimney is insulated against shock. Thus, the lantern can be easily transported without undue concern for damage to the relatively fragile glass chimney 14.

Figure 4A:
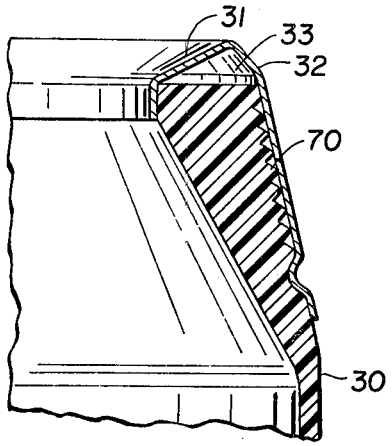
FIG. 4*a* is a side view and partial cross-section showing a detail of the wax dam according to one preferred embodiment.
Figure 4B:
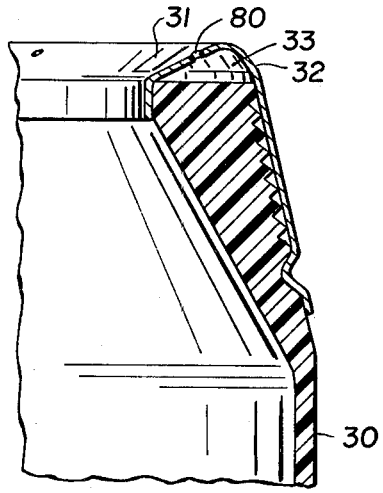
FIG. 4*b* is a side cross-sectional view of a wax dam showing a second preferred embodiment.

With particular reference to FIGS. 4*a* and 4*b*, there is shown a specific feature of the invention. FIG. 4*a* illustrates one embodiment of the cap 24 and candle holder 22. The cap 24, which is preferably of metal is an annulus about the top rim of candle tube 30. The top rim of candle tube 30 includes an inner wall which is tapered radially inward to serve as an end stop for an enclosed candle.

The candle tube 30 is preferably made of a material such as nylon or Teflon, to minimize fraction between the candle and the tube 30 and to provide insulation and control of dripping as well as the rate of burn. The tube 30 is thickest near the top at cap 24 for this purpose. The top rim of tube 30 includes a pattern of annular serrations or threads 70 around the tip. Threads 70 are adapted to abut the inwardly disposed surface of the outer wall of cap 32 thereby to form a labyrinth seal between the cap wall and the tube rim. Further, the cap defines a counterbore 31 at the tip of tube 30. Further, the end wall of tube 30 and the counterbore forming portion of the wall of cap 32 define a hollow annulus 33 around the tip of tube 30. The thread 70 and abutting wall portion of cap 32 form a labyrinth seal. The combination of the labyrinth seal, the hollow annulus 33, the counterbore 31, and the inner flanger of the cap 32 are operative to inhibit the leaking of wax from the interior of tube 30.

Referring to FIG. 4*b*, there is shown a further improvement to minimize the leakage of wax from the interior of tube 30. In addition to all of the features described in conjunction with FIG. 4*a*, there is included at least one perforation 80 through cap 32 to expose the interior of the annulus 33 to the atmosphere. It has been found that pressure otherwise builds up within the annulus which may force some leakage through the labyrinth seal. The provision of an aperture as shown inhibits the pressure buildup and thereby minimizes the wax leakage without diminishing the advantages of a metal seal cap. The sealed cap serves the ultimate function of containing the liquid wax of a flaming candle within its circumference, minimizing wax leakage. Wax may otherwise overflow and leak into the interior of the lantern, soiling and gumming the workings and diminishing the useful burning time. For example, if the seal is not effective, the candle may burn out in as little as one half hour, whereas if the seal is effective and the tip is properly insulative, a burn time of three and one half hours can be expected.

Various features and advantages of the invention have been described with reference to specific embodiments. Other features, modification, and advantages will be clear to those or ordinary skill in the art without departing from the concept of the invention. It is therefore not intended that the scope of the invention be limited except as indicated by the appended claims.

What is claimed is:

1. A lantern for holding a candle comprising:

a cylindrical base member;

a reflector shield telescopically coupled to said cylindrical base member;

a glass chimney mounted within said reflector shield;

a shock absorbing elastomeric plug mounted to said base member and closing one end thereof;

a candle holder mounted within said base member, wherein said candle holder comprises:

a base mount connected to said plug;

a tube having one end attachable to said base mount;

a spring disposed within said tube and engaging said base mount;

a cup connected to said spring for engaging the base of the candle;

said tube including an increasingly thicker, inwardly tapered inner wall portion toward the top end of the tube constructed of a thermally insulative material selected from the group consisting of nylon and Teflon for insulating the candle and engaging the top end of the candle; and an annular heat conductive metal cap covering the top end of said tube for protecting the top end of said tube and for minimizing the overflow of wax.

2. A candle lantern according to claim 1 wherein said tube further includes serrations in the outer wall adjacent the top end thereof, and wherein said cap comprises a first annular wall for engaging the inner wall of said tube, a second annular wall for engaging the outer wall of said tube in abutment with said serrations and a third annular wall defining a counterbore and connecting between said first annular wall and said second annular wall for constraining wax within said candle holder and for inhibiting the leakage of wax.

3. A candle lantern according to claim 2 wherein said cap, third annular wall and a top rim portion of said tube together define a hollow annulus at the top end of said candle holder between said counterbore and said labyrinth seal for trapping hot wax and gasses.

4. A candle lantern according to claim 2 wherein said third annular wall includes at least one orifice exposing said hollow annulus to the atmosphere for relieving fluid pressure within said hollow annulus.

5. A lantern according to claim 1 wherein indentation means are provided for retaining said shield in at least three fixed and stable positions relative to said base member, namely a first collapsed position, a second fully extended position wherein the candle wick is exposed for lighting and a third position intermediate of said first and second positions wherein the candle is protected by said chimney against undesired drafts.

6. A candle lantern according to claim 5 further including a cable connected to said cap and a relatively rigid hook of a diameter corresponding to said cylindrical base member adapted to engage said base member for holding said lantern in a collapsed position.

7. A candle lantern for holding a candle having a top end and a bottom end, and especially adapted for outdoor use such as camping, said candle lantern comprising a hollow cylindrical base member having perforations through the walls thereof for induction of air, a semi-cylindrical shield member adapted to be telescoped within said base member, said shield member being snap mountable to said base member in three positions, namely a first fully collapsed position, a second fully extended position, and a third position intermediate of said first and second position;

a hollow cylindrical glass chimney partially enclosed within said reflector shield for protecting a candle flame against drafts;

a cap member attached to an end of said reflector shield and including perforations therein for the exhaust of hot gasses;

an elastomeric annulus attached to an upper ring of said base member and including means for engaging said reflector shield and said selected positions;

an elastomeric plug for enclosing a bottom end of said base member; said annulus and said plug extending radially outwardly of said upper rim and said bottom end of said base member respectively; and a candle holder, said candle holder comprising a tubular elastomeric base mount integrally formed with said plug and including fluting along the outwardly disposed walls;

a tube having minimal wall friction attachable to said base mount;

a helical spring disposed within said tube and at one end engaging said plug;

a cup engaging the other end of said spring for receiving a candle, said cup being concentrically stepped for accommodating various diameter candles;

said tube including an inwardly tapered inner wall portion adjacent the top end thereof for engaging the top end of said candle, said wall portion for engaging the top end of said candle being constructed of a thermally insulative material selected from the group consisting of nylon and Teflon; and a metal cap engaging and covering the top end of said tube and an annular portion of said inner wall and said outer wall adjacent said end for protecting said top end.

* * * * *